US007798838B2

(12) United States Patent
Grieff et al.

(10) Patent No.: US 7,798,838 B2
(45) Date of Patent: Sep. 21, 2010

(54) ELECTRICAL PLUG ADAPTER

(75) Inventors: Timothy B. Grieff, Odell, IL (US); Bruce C. Nemec, Madison, WI (US); Jason Rohr, Palmyra, WI (US)

(73) Assignee: Grieff Enterprises, Inc., Odell, IL (US)

( * ) Notice: Subject to any disclaimer, the term of this patent is extended or adjusted under 35 U.S.C. 154(b) by 0 days.

(21) Appl. No.: 12/540,531

(22) Filed: Aug. 13, 2009

(65) Prior Publication Data

US 2010/0035481 A1 Feb. 11, 2010

Related U.S. Application Data

(63) Continuation-in-part of application No. 12/200,838, filed on Aug. 28, 2008, now abandoned.

(60) Provisional application No. 60/968,514, filed on Aug. 28, 2007.

(51) Int. Cl.
*H01R 13/625* (2006.01)

(52) U.S. Cl. ..... 439/346; 439/692

(58) Field of Classification Search ..... 439/692, 439/346

See application file for complete search history.

(56) References Cited

U.S. PATENT DOCUMENTS

| | | | |
|---|---|---|---|
| 3,440,591 | A | 4/1969 | Whalen |
| 4,157,855 | A | 6/1979 | Chan |
| 4,784,611 | A | 11/1988 | Poulin et al. |
| 4,932,886 | A | 6/1990 | Glaser |
| 5,108,301 | A | 4/1992 | Torok |
| 5,129,836 | A | 7/1992 | Ursich |
| 5,197,897 | A | 3/1993 | Torok |
| 5,281,162 | A | 1/1994 | Ursich |
| 5,344,333 | A | 9/1994 | Haag |
| 5,393,239 | A | 2/1995 | Ursich |
| 5,413,498 | A | 5/1995 | Ursich |
| 5,427,543 | A | 6/1995 | Dynia |
| 5,921,798 | A | 7/1999 | Ursich |
| 5,941,724 | A | 8/1999 | Reed |
| 6,171,129 | B1 | 1/2001 | Phillips |
| 6,234,823 | B1 | 5/2001 | Fuess |
| 6,267,612 | B1 | 7/2001 | Arcykiewicz et al. |
| 6,428,339 | B1 | 8/2002 | Davidson et al. |

(Continued)

*Primary Examiner*—Briggitte R Hammond
(74) *Attorney, Agent, or Firm*—Lempia Braidwood LLC

(57) ABSTRACT

An electrical plug adapter has a plug body, female receptacles in one surface of the plug body, male prongs extending from another surface of the plug body, and a male catch mechanism associated with one of the male prongs and resiliently biased to a catch position relative to the one male prong. The male catch mechanism is configured to catch on an object in a standard electrical outlet when the male prongs are inserted into corresponding receptacles of the outlet. An actuator on the plug body is configured, when actuated, to selectively move the male catch mechanism to a release position relative to the one male prong and allow the male prongs to be removed from the corresponding receptacles. A one-way retention mechanism can be associated with one of the female receptacles and configured to permanently retain a male connector prong from a standard electrical connector plug when inserted into the female receptacles. The male prongs can be configured so as to capable of insertion into the corresponding receptacles when the male catch mechanism is in the catch position without actuating the actuator.

20 Claims, 14 Drawing Sheets

U.S. PATENT DOCUMENTS 6,652,307 B2 11/2003 Tatz
6,875,040 B1 4/2005 O'Keefe et al.
6,896,537 B2 5/2005 Burton
7,077,683 B1 7/2006 Ross
7,172,451 B1 2/2007 Ratzlaff
7,175,463 B2 2/2007 Burton
7,182,615 B1 2/2007 Liu
7,186,130 B1 3/2007 Miller

ELECTRICAL PLUG ADAPTER

RELATED APPLICATION DATA

This patent is a continuation-in-part of U.S. application Ser. No. 12/200,838 filed Aug. 28, 2008, which is related to and claims priority benefit of U.S. provisional patent application Ser. No. 60/968,514 filed Aug. 28, 2007. The entire contents of each of these earlier filed applications are hereby incorporated by reference.

BACKGROUND OF THE INVENTION

1. Field of the Disclosure

The present disclosure is generally directed to electrical plug adapters, and more particularly to a plug adapter that inhibits unintended removal of the plug from a standard outlet.

2. Description of Related Art

There are many different types of electrical plug adapters known in the art. Many of these adapters are equipped to mate two prong female receptacles with three prong male connectors, or vice versa, with one another. Most of these known adapters do not provide any enhanced physical connection or lock feature to secure the electrical plug adapter with a mating component. Some known adapters have a locking feature wherein the adapter can be locked with another mating component. These types of adapters typically require a male plug and a female receptacle that each are equipped with a specialized portion of the locking component mechanism, thus requiring a special female socket receptacle and correspondingly special male prong.

U.S. Pat. No. 6,171,129 to Phillips discloses an electrical adapter with a male end and a female receptacle end. The female end is incorporated with a selective lock and release mechanism. A male plug can be inserted into the female receptacle and be selectively retained physically therein. Two of the three male prongs on the male end of the adapter are equipped with a spring device. These spring devices are biased to one position where a portion of the devices are spaced from the respective male prongs and engage a part of the female receptacle to secure the male prongs within the receptacle. Consequently, these spring devices must be selectively moved by the user to a position in engagement with the prongs in order to permit both insertion and removal of the male prongs from the female receptacle. In turn, a first button or actuator is provided on the adapter to actuate both of the springs such that the male prongs can be inserted into and subsequently removed from the receptacle. A second button or actuator is also provided on the adapter to actuate a lock and release mechanism at the female end.

U.S. Pat. No. 7,077,683 to Ross discloses an electrical plug adapter with a male prong that has a serrated or sawtooth configuration. Ross also discloses a female receptacle with a release and lock device. The female end lock and release device includes a tooth within the female receptacle that can selectively engage with, or be moved out of engagement with, a saw-toothed edge of the male prong. Thus, Ross also requires a specialized female receptacle to engage the specialized male prong in order to function properly.

SUMMARY OF THE INVENTION

In one example of an electrical plug adapter according to the teachings of the invention, the plug adapter has a plug body, female receptacles in one surface of the plug body, male prongs extending from another surface of the plug body, and a male catch mechanism associated with one of the male prongs and resiliently biased to a catch position relative to the one male prong. The male catching mechanism is configured to catch on an object in a standard electrical outlet when the male prongs are inserted into corresponding receptacles of the outlet. An actuator on the plug body is configured, when actuated, to selectively move the male catch mechanism to a release position relative to the one male prong and allow the male prongs to be removed from the corresponding receptacles.

In one example, the plug adapter can have a one-way retention mechanism associated with one of the female receptacles and can be configured to permanently retain a male connector prong from a standard electrical connector plug when inserted into the female receptacles.

In one example, the male prongs of the plug adapter can be inserted into the corresponding receptacles when the male catch mechanism is in the catch position without actuating the actuator.

In one example, the male catch mechanism of the plug adapter can include a hook positioned at an end of part of the male catch mechanism.

In one example, the male catch mechanism of the plug adapter can include a hook that projects beyond a profile edge of the one male prong when the male catch mechanism is in the catch position. The hook can lie within the profile edge of the one male prong when the male catch mechanism is in the release position.

In one example, the male catch mechanism of the plug adapter can include a hook that catches on an edge of an opening in the standard electrical outlet when the male catch mechanism is in the catch position and the male prongs are inserted into the corresponding receptacles.

In one example, the plug adapter can have a spring coupled between the male catch mechanism and the actuator, wherein the spring can be configured to bias the male catch mechanism to the catch position.

In one example, the male catch mechanism of the plug adapter can include a catch lever having a catch leg adjacent to a profile edge of the one male prong and an actuator leg located in the plug body. The lever can be pivotably coupled to the plug body. The catch leg can include a hook positioned at a tip of the catch leg. The actuation leg can be coupled to a spring.

In one example, the plug adapter can have metal tang forming a one-way retention mechanism associated with one of the female receptacles and configured to permanently retain a male connector prong from a standard electrical connector plug when inserted into the female receptacles. The metal tang can project laterally inward in one female receptacle and can be configured to engage an opening in a male connector prong when inserted therein and prevent removal therefrom.

In one example, the plug adapter can have a gripping feature or surface on the plug body. The gripping feature or surface can be formed from a material different than a material of the remaining portions of the plug body.

In one example, the male catch mechanism of the plug adapter can include a hook that is positioned at one end of part of the male catching mechanism. The hook can have an angled or tapered leading end.

In one example, the male catch mechanism of the plug adapter can include a hook with a leading end that is shaped to cause the catch mechanism to move from the catch position to the release position when the male prongs are initially inserted into the corresponding receptacles and the catch mechanism returns to the catch position after the male prongs are inserted into the corresponding receptacles.

In one example, the plug adapter is an electrical connector plug with an electrical cord extending from another surface of the plug body and the electrical cord is coupled to an electric appliance.

In one example, the male catch mechanism of the plug adapter can include a catch blade with a tooth or a serrated edge. The catch blade can be moveable such that the tooth or serrated edge moves toward the one male prong to the release position when the actuator is actuated and away from the one male prong when returning to the catch position.

In one example, the male catch mechanism of the plug adapter can include a catch blade that is positioned side-by-side adjacent and parallel to the one male prong.

In one example, the male catch mechanism of the plug adapter can include a serrated edge that is parallel to but spaced from an edge of the one male prong in the catch position and that is parallel and side-by-side adjacent to the edge of the one male prong in the release position.

In one example, the male catch mechanism of the plug adapter can include a catch blade. The catch blade can be configured to pivot or move in a direction perpendicular to the one male prong between the catch position and the release position.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The plug adapter examples disclosed herein solve or improve upon one or more of the above-noted and/or other problems and disadvantages with known plug adapters. In one example, a plug adapter disclosed herein has a catch mechanism on a single male prong to engage with and be selectively released from engagement within a standard, conventional female electrical socket receptacle or outlet. In another example, a plug adapter is disclosed herein that has a female receptacle configured to permanently retain one or more male prongs of a standard electrical connector on the cord of an appliance, tool, or the like. In another example, a plug adapter is disclosed herein has a catch mechanism to engage with and be selectively released from engagement within a standard female electrical socket receptacle or outlet and can be inserted therein with the catch mechanism in a catch position. In another example, a plug adapter is disclosed herein that can be employed directly on the end of a standard electrical connector (from an appliance, tool, or the like) as the plug connector.

Figure 1:
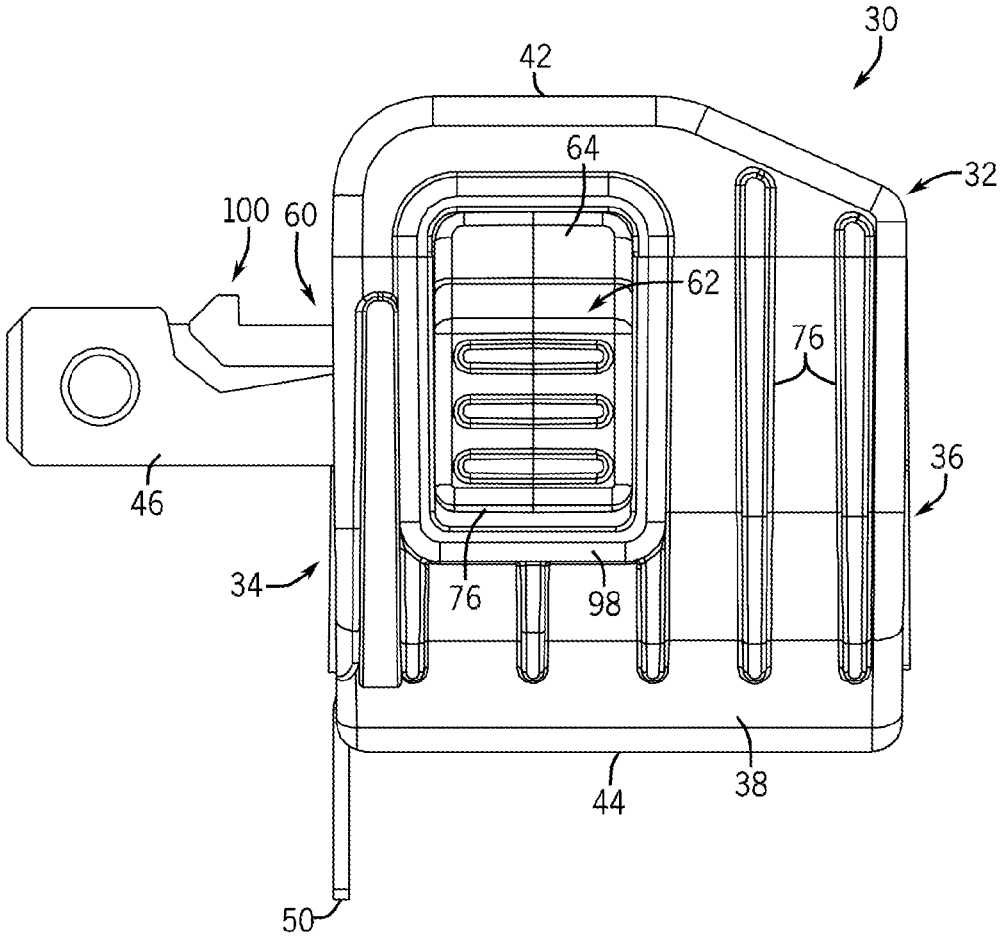
FIG. 1 shows a side view of one example of a plug adapter constructed in accordance with the teachings of the present invention.
Figure 2:
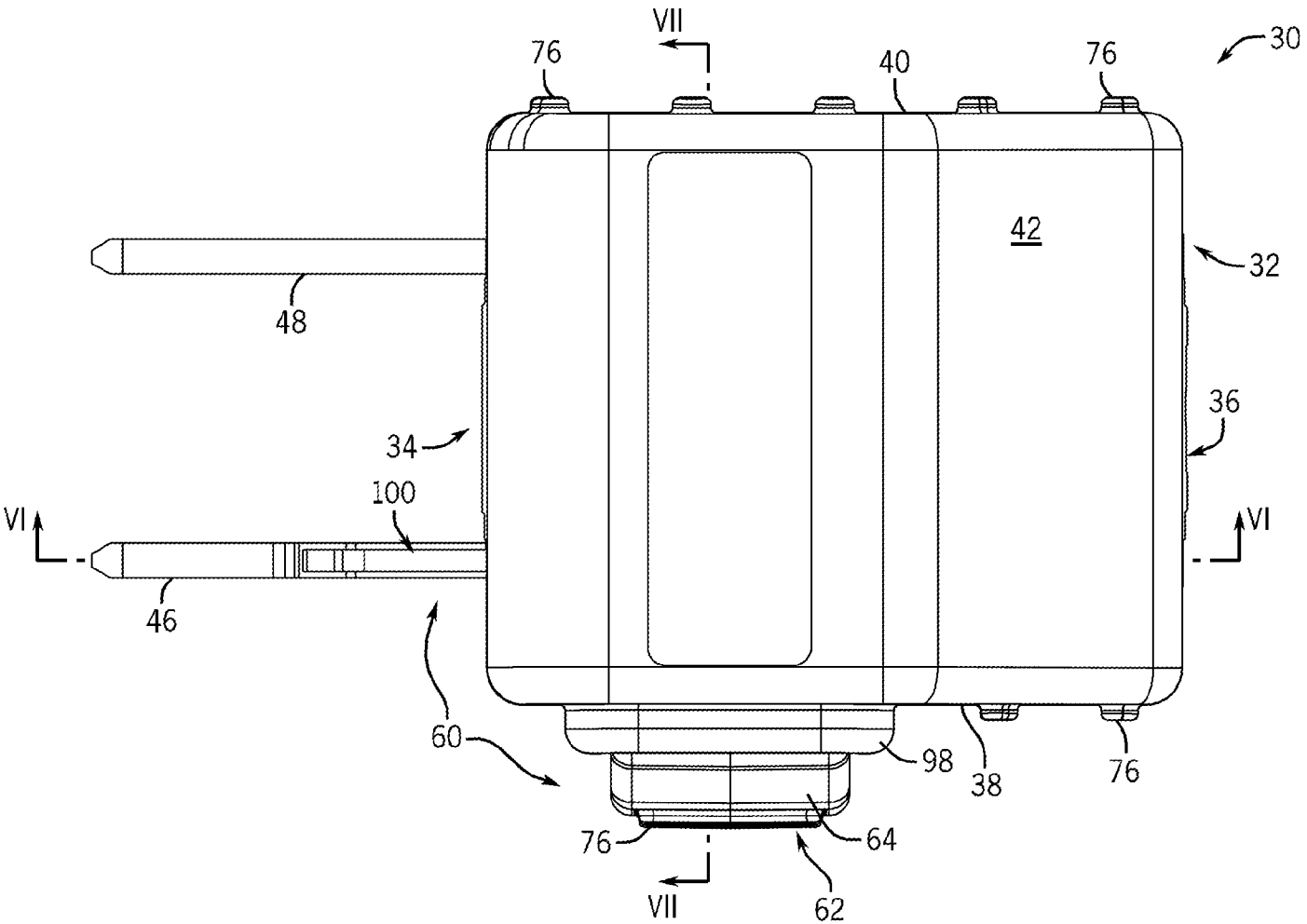
FIG. 2 shows a top view of the plug adapter in FIG. 1.
Figure 3:
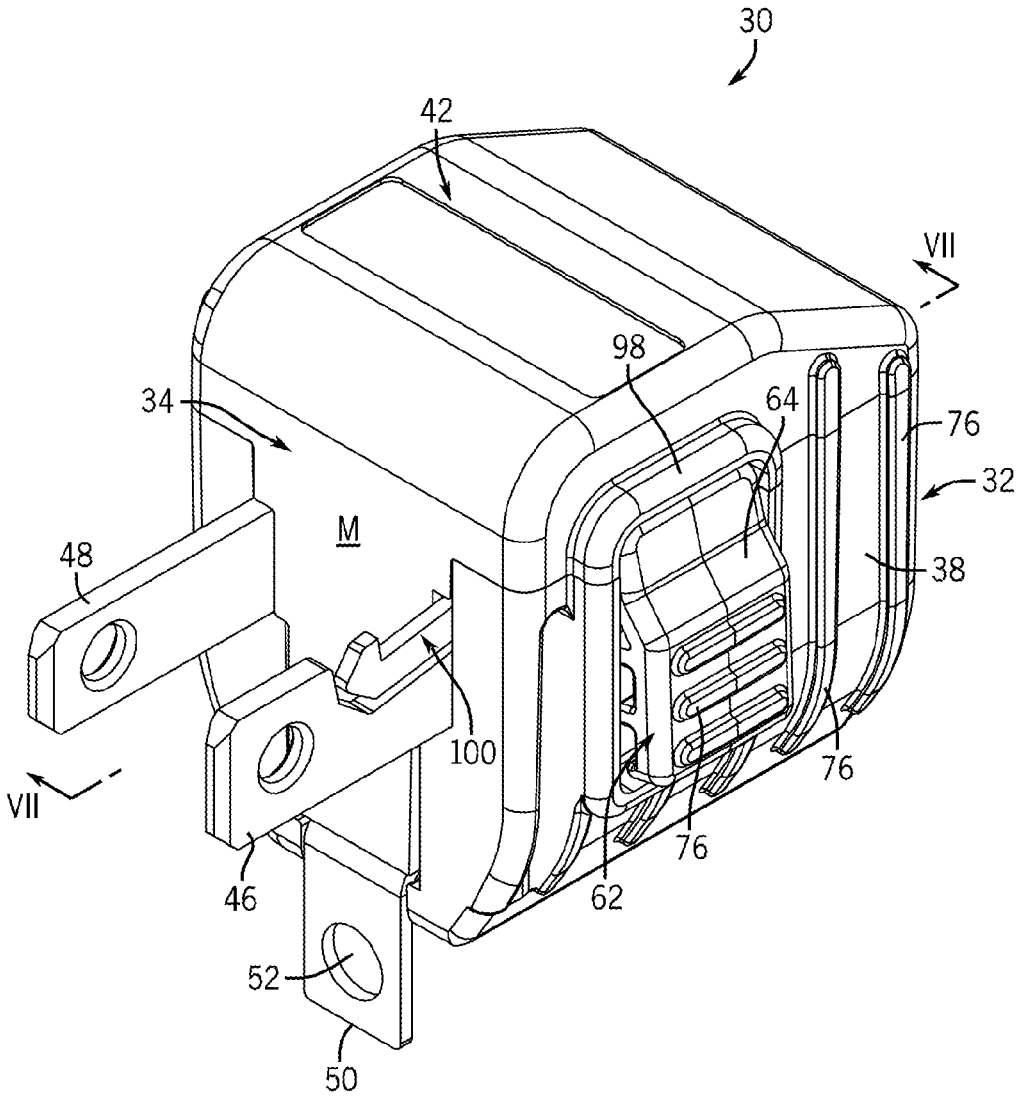
FIG. 3 shows a perspective view of the male end of the plug adapter in FIG. 1.

Turning now to the drawings, FIGS. 1-3 show one example of a plug adapter 30 constructed in accordance with the teachings of the present invention. In this example, the plug adapter 30 includes a rectangular or polygon shaped plug body 32. The plug body 32 has a male end 34 with a surface M and a female end 36 with a surface F opposite the male end 34. The plug adapter 30 also has a pair of opposed sides 38, 40, a top 42, and a bottom 44. The shape, size, and contour of the plug body 32 can vary within the spirit and scope of the invention. The plug body 32 is not intended to be limited to any particular size or shape. The plug body 32 can also be fabricated from any number of suitable, non-conductive materials and using any number of suitable processes. The plug body 32 can be a molded body of a plastic or hard rubber material providing a substantially rigid, durable, protective cover for the adapter components.

As shown in FIGS. 1-3, two male prongs extend outward from the surface M on the male end 34 of the plug body 32. The two male prongs include a positive male prong 46 and an adjacent neutral male prong 48. The positive prong 46 is to be inserted into a corresponding female positive receptacle of a standard wall outlet and the neutral male prong 48 is to be inserted into a corresponding female neutral receptacle of the outlet. In this example, the adapter 30 also has an attachment or fastening tab 50 with an aperture 52 through the exposed end of the tab. The tab 50 can be provided for optionally securing the adapter 30 to a wall outlet using the faceplate screw as in known in the art. In this example, the tab 50 is a flat tab and is attached to the surface M on the male end 34. The tab 50 extends downward below the plug body 32, parallel with the surface M. In one alternate example, the tab need not be provided. In another alternate example, the plug adapter 30 can have three male prongs including, though not shown in FIGS. 1-3, ground male prong configured to be inserted into a corresponding female ground receptacle of a wall outlet. The number, configuration, and arrangement of the male prongs can vary from the examples shown and described herein. The plug adapter 30 can be configured for lower amp usage, such as 15 amps, that employs a common prong arrangement or can be configured for higher amp usage, such as 20 amps and above, that would utilize an alternate prong arrangement.

In accordance with the teachings of the present invention, at least one of the male prongs 46, 48 can be configured to provide a catch function. As shown in FIGS. 1 and 3, the plug adapter 30 has a male catch mechanism 60 associated with the neutral male prong 48. Thus, the prong 48 in this example is a male latching prong while the positive prong 46 is of a conventional male prong configuration. In other examples, the male catch mechanism 60 can be associated with the positive male prong 46 or one can be provided on each of the two or more male prongs. Details and aspects of the male catch mechanism 60 are discussed below.

The plug adapter 30 in this example also has an actuator 62 as part of and coupled to the catch mechanism 60. The actuator 62 has an actuation button 64 exposed on exterior of the plug body 32. In this example, the button is located on the side 38 of the plug body 32, but could be located elsewhere on the body, if desired, and yet function as intended. The actuator 62 is configured to actuate the male catch mechanism 60 as is also described in greater detail below.

Figure 4:
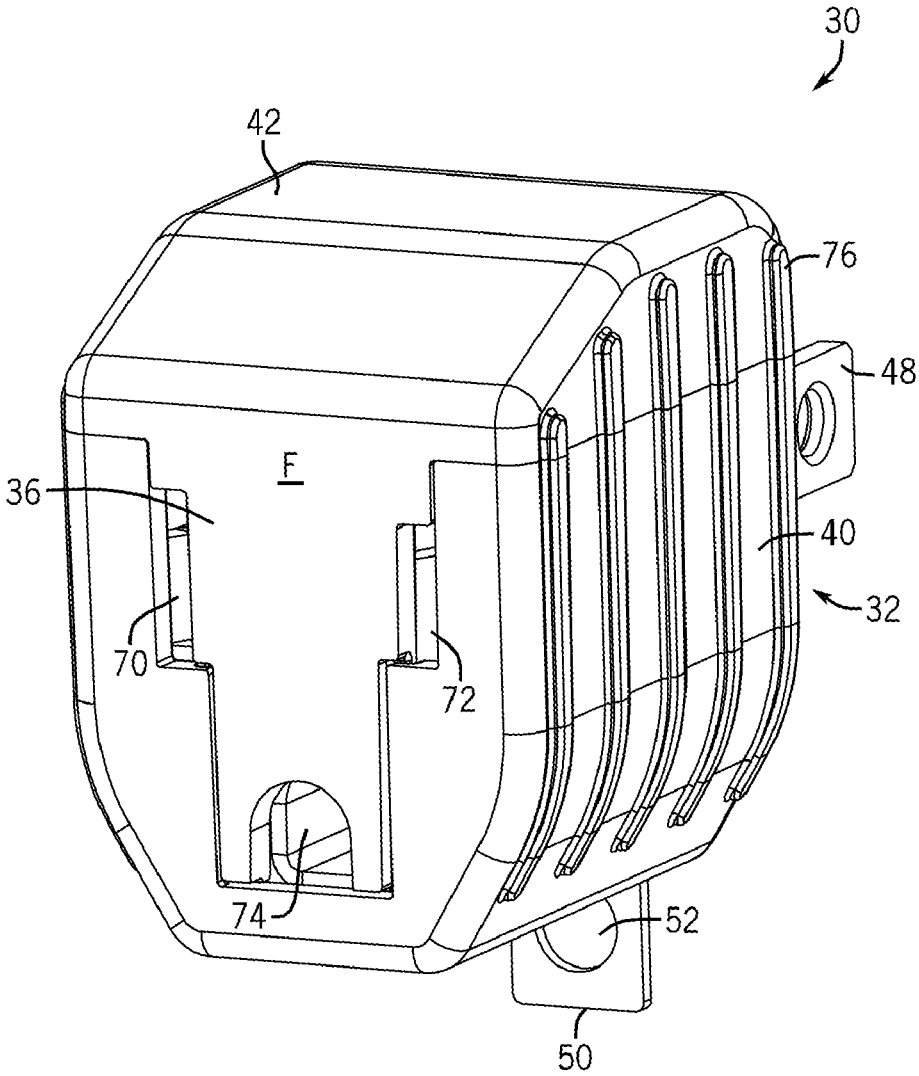
FIG. 4 shows a perspective view of the female end of the plug adapter in FIG. 1.

As shown in FIG. 4, three female receptacles are open to and extend into the surface F on the female end 36 of the plug body 32. In this example, the three receptacles include a positive female receptacle 70, a neutral female receptacle 72 adjacent the positive receptacle 70, and a ground female receptacle 74 beneath the receptacles 70, 72. Positive receptacle 70 is configured to receive therein a positive male prong from an appliance connector, the neutral receptacle 72 to receive the neutral prong of the connector, and the ground receptacle 74 to receive the ground prong of the connector.

In one example, the plug adapter 30 can have grip surfaces or grip features exposed on the sides 38, 40 or other surfaces of the plug body 32. The grip surfaces or features can be configured to provide a user with ergonomic and/or tacky locations on the body 32 for holding the adapter while inserting or removing the plug adapter 30. In general, a grip surface (not shown) can be over molded or otherwise manufactured using a dual mold or insert mold operation when forming the plug body. The grip surfaces can be formed of a material that is softer, i.e., of a lower durometer, than the material used to mold or manufacture the remainder of the plug body 32. In one example, such grip surfaces can be formed from a thermoplastic elastomer (TPE) material whereas the remaining portion of the body can be molded of a harder, higher durometer plastic, composite, or rubber material. The grip surfaces can be formed from a number of other materials and still fall within the teachings of the present invention.

In the disclosed example, the plug body 32 is formed having a plurality of raised ridges or ribs 76. In one example, the ribs 76 can be integrally molded as a part of the body and from the same material as the body. These ribs 76 can be provided on any surface of the adapter 30 and in this example are provided both sides 38 and 40 of the body, as well as on the surface of the actuator button 64. The ribs 76 can be ribs, ridges, non-linear bumps, dimples, or other surface formations configured to enhance a user's grip on the adapter 30 during use. In another alternate example, the ridges or ribs 76, or other surface features, can be over molded, dual molded, insert molded, or otherwise formed on the plug body 32 using a grip enhancing material in the same manner described above for the optional grip surface. For example, the ribs 76 shown in FIGS. 1-4 can be raised relative to the surfaces of the plug body and be molded from a softer TPE material, if desired.

Figure 5:
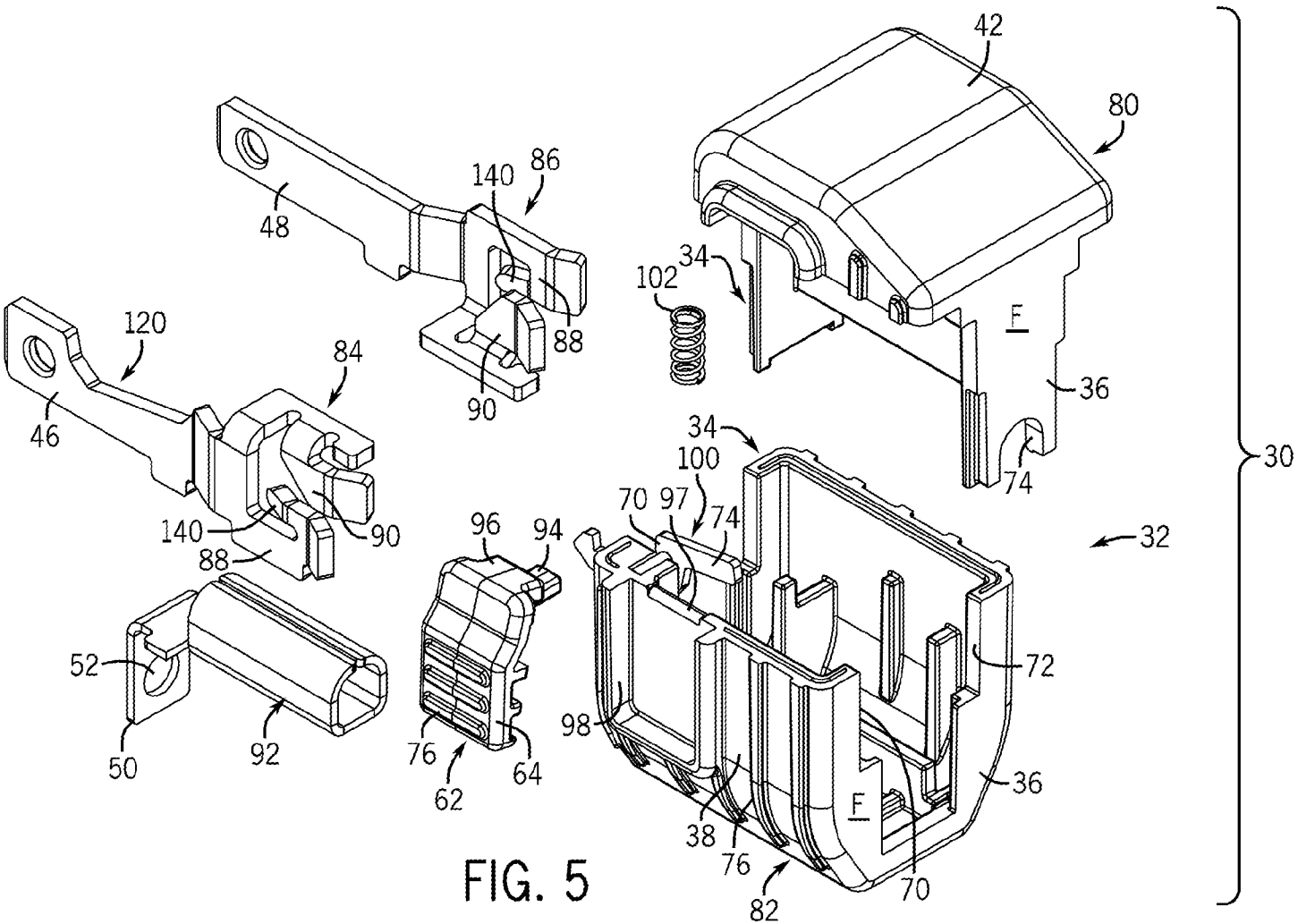
FIG. 5 shows an exploded view of the plug adapter in FIG. 1.

FIG. 5 illustrates the assembly and internal components of the plug adapter 30 in greater detail. In this example, the plug body 32 generally has an upper section 80 and a lower section 82 that can be molded separately and fitted together when assembled. The sections 80, 82 can snap together, be fastened to one another, be heat welded to one another, be sonically welded to one another, or the like. The male prongs 46, 48 each have a back end 84, 86, respectively, positioned to align with the respective female receptacle 70, 72 with the assembled body. The back end 84, 86 of each male prong has a pair of spaced apart contacts 88, 90 forming a gap therebetween. The gap on each back end 84, 86 is sized so that the corresponding contacts 88, 90 each engage a surface of a male connector prong received in each female receptacle 70, 72. The tab 50 is an integral extension of a ground coupler 92 that is aligned within the female ground receptacle 74 when the body is assembled. The ground coupler 92 in this example is a tubular structure configured to receive and engage a male ground connector prong. When the plug body sections 80 and 82 are assembled, the contours of their respective mating edges on the female end surface F form all three of the female receptacles 70, 72, and 74 in the surface.

The actuator 62 of the catch mechanism 60 includes a finger 94 that projects away from the button 64 and is connected to the button by a bridge 96 at the top of the actuator. The bridge 96 rests on a fulcrum edge or ledge 97 on the lower section 82 and is loosely captured between the ledge and the upper section 80 in the assembly. This positions the button 64 on the side 38 of the body 32. The button 64 is surrounded by a raised wall 98 on the side 38 that defines a home region for the button on the plug body.

Figure 6:
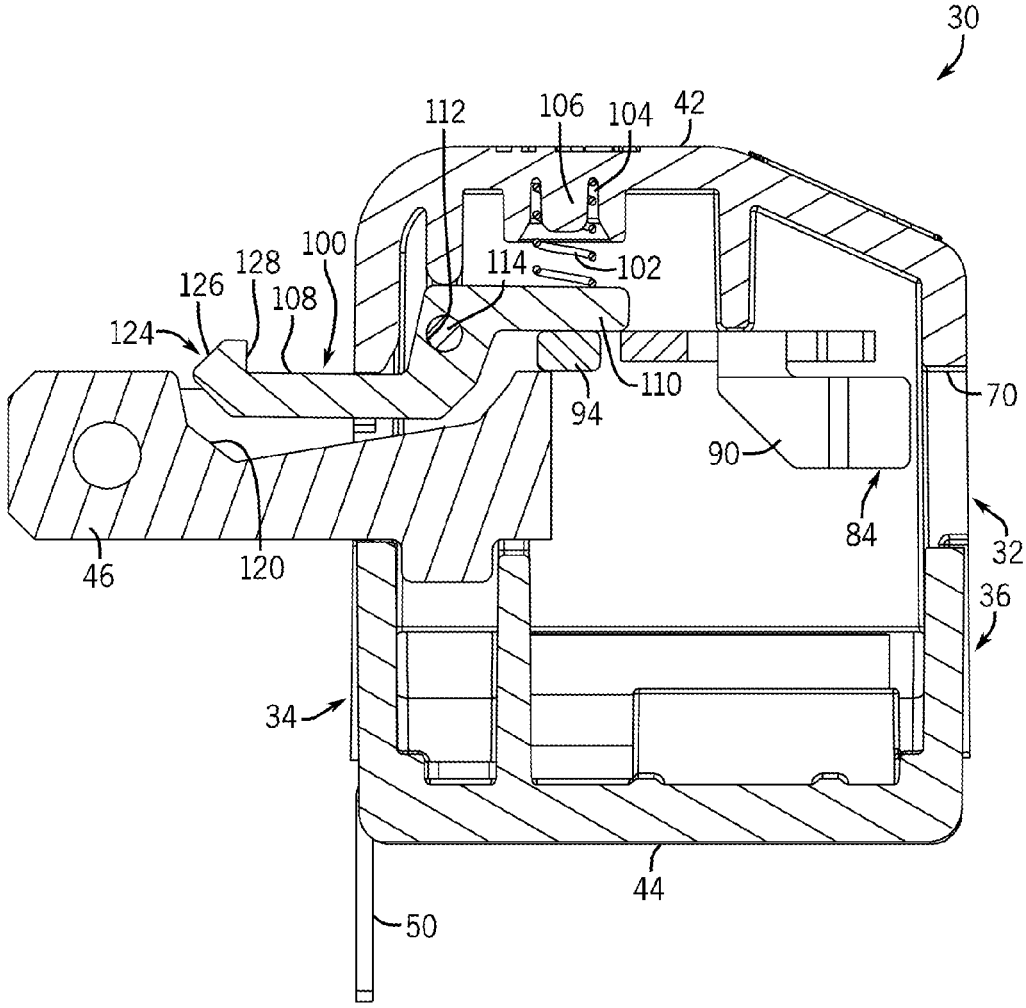
FIG. 6 shows a cross-section along line VI-VI of the plug adapter in FIG. 2.
Figure 7:
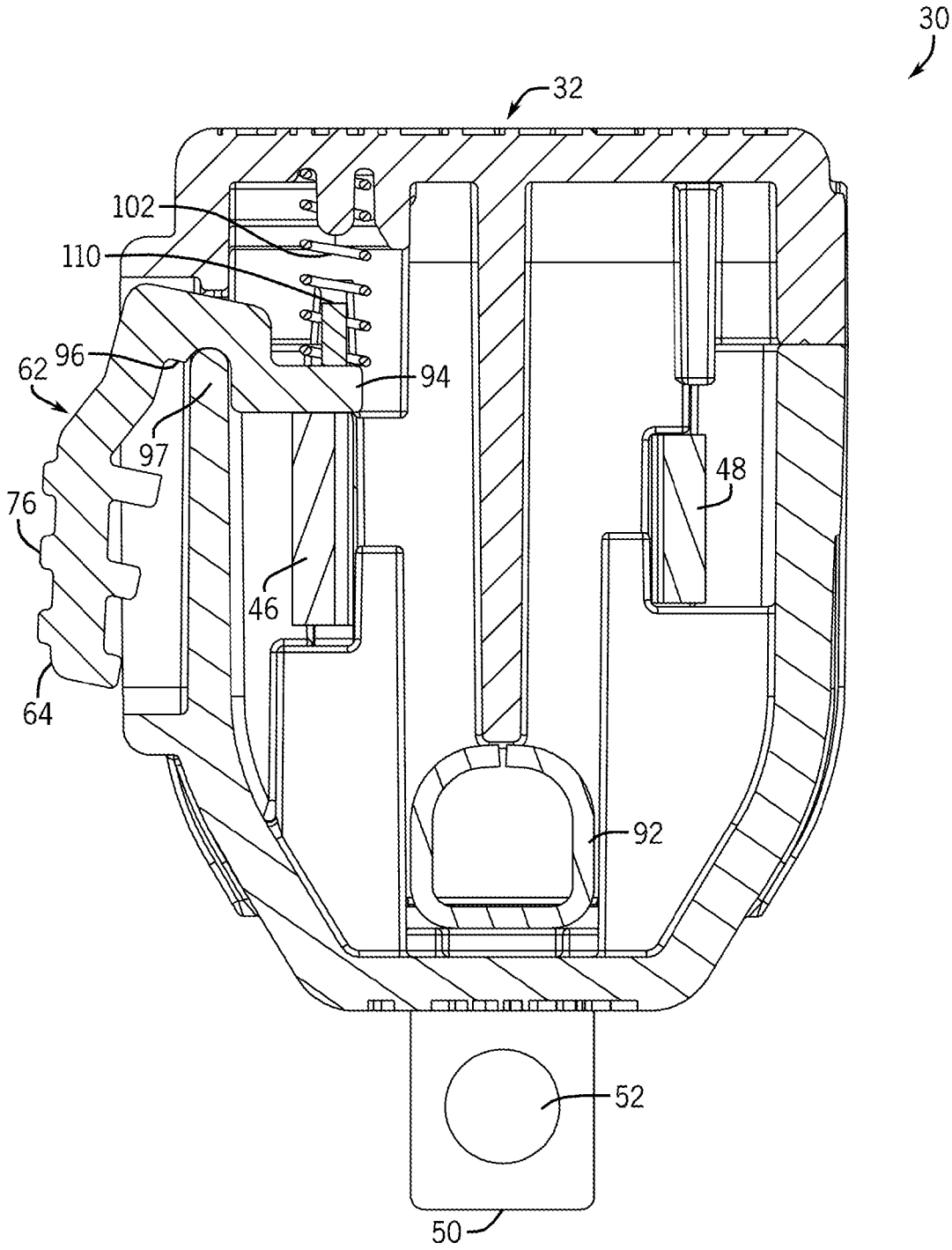
FIG. 7 shows a cross-section along line VII-VII of the plug adapter in FIG. 2.

The catch mechanism 60 also includes a male catch lever 100, best illustrated in FIG. 6, and a biasing spring 102 captured within the body sections 80, 82 when assembled. The upper end of the coil spring 102 is seated and retained in a spring groove 104 and over a stud 106 that projects down from the top 42 of the upper section 80. The catch lever 100 has a catch leg 108 that extends out through the male end 34 of the plug body and has an actuator leg 110 internal to the body. The catch lever has a pivot opening 112 positioned between the two legs 110, 112. A pivot pin 114 projects inward from the side 38 of the lower section 82 on the plug body and catch lever 100 is received on and pivots about the pin. The lower end of the spring 102 contacts the actuator leg 110 and biases the catch lever 100 to a catch position shown in FIGS. 1, 6, and 7. The actuator leg 110 bears against the finger 94 of the actuator 62. The underside of the bridge 96 has a curved seat, which bears on the ledge 97 and allows the actuator 62 to rock on the ledge. As shown in FIG. 7, the spring 102 biases the actuator leg 110 and, thus, the finger 94 downward, which in turn rocks the button 64 away from the plug body. Downward travel of the catch lever can be limited by controlling the degree of actuator can rock on the ledge 97 or by contact with a stop in the body. In this example, the rocking of the actuator is limited by the contour of the curved seat and/or by the finger 94 abutting against a surface on the back end 84 of the male prong 46 (see FIG. 7).

Figure 8:
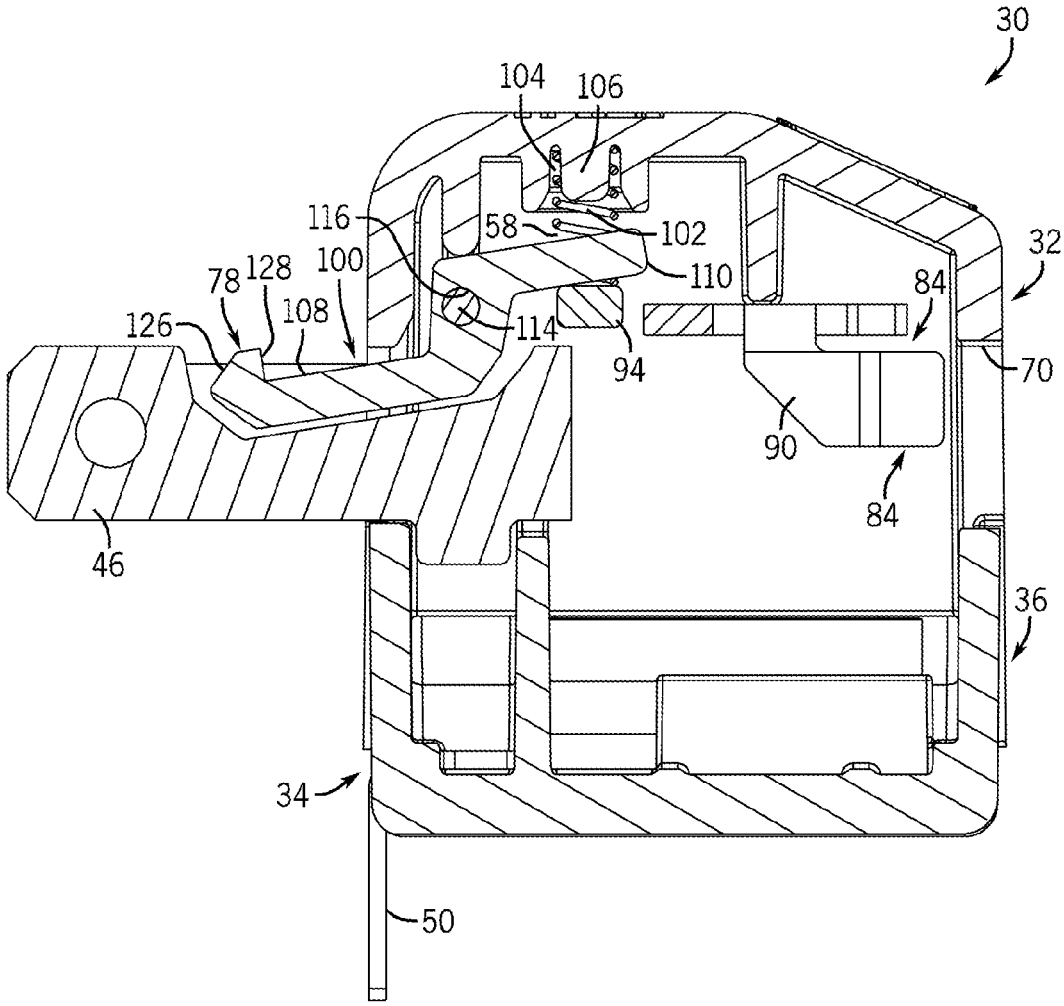
FIG. 8 shows a cross-section along line VIII-VIII of the plug adapter in FIG. 3.
Figure 9:
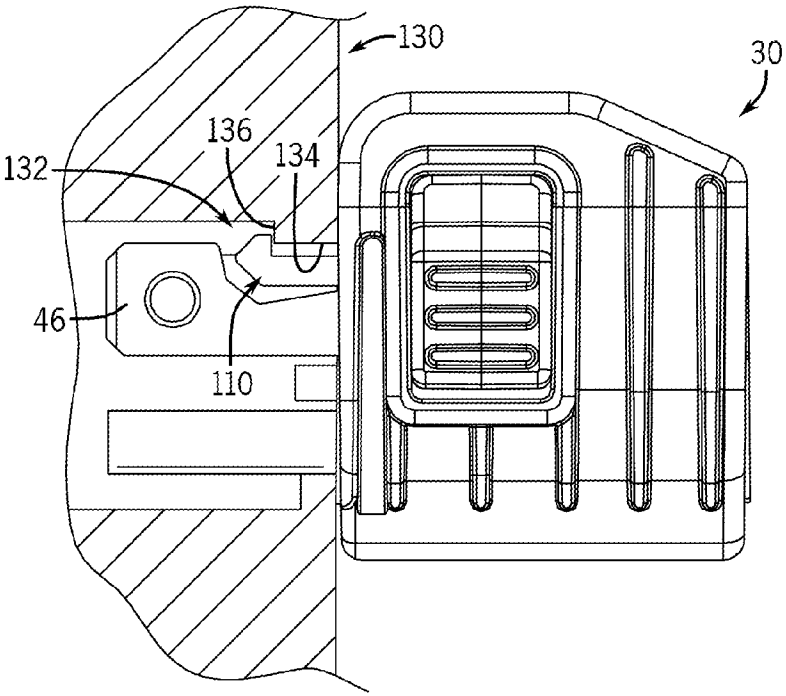
FIG. 9 shows the plug adapter in FIGS. 1 and 6 inserted into a standard wall outlet.

In this example, the actuator 62 is configured to facilitate movement of the male catch lever 100 between the catch position and a release position depicted in FIGS. 3 and 8. An indentation or notch 120 is formed in the top or profile edge 122 on the male prong 46 in this example. The catch lever 100 is aligned with and parallel to the prong 46 as best shown in FIGS. 2 and 3. The catch leg 108 has a hook 124 that projects upward relative to the notch 120 at the tip of the catch leg. The hook 124 has a lead edge 126 that is angled or tapered and a trailing edge or catch edge 128 that is vertical and straight in this example. With reference to FIGS. 1, 6, and 7, the male catch mechanism 60 is normally biased to the catch position by the spring 102. In this position, the hook projects up above the elevation of the top edge 122 on the latching prong 46. By pushing the button 64 inward against the side 38 of the body 32, the finger 94 moves up. The finger will raise the actuator lever 110 up against the spring bias as in FIG. 8, which in turn lowers the catch leg 108 into the notch 120. In the release position, the hook 124 is below or level with the prong top edge 122.

In this example, the catch lever is a flat metal component that can be stamped or die cut from sheet stock. In other examples, the male catch lever 100 can be round or non-flat in cross-section, can be shaped differently than as shown, and can be formed of other suitable materials such as composites, plastics, or the like and yet still fall within the teachings of the present invention.

With reference to FIGS. 6-9, the plug adapter 30 can be inserted into a wall outlet 130 with the male prongs 46, 48 received in corresponding female receptacles 132 (shown only schematically in FIG. 9) in the outlet. In this example, the plug adapter 30 is configured to permit the male prongs 46, 48 to be inserted into the corresponding female receptacles 132 while the male catch mechanism 100 is in the catch position of FIGS. 1, 6, and 7 and without having to actuate the actuator 62. In this example, the position of the hook 124 and the leading end or edge 126 is such that only the leading edge 126 is exposed above the top edge 122 of the prong 46 in the catch position (see FIGS. 1 and 6). The remainder of the catch leg 108 is still seated in the notch 120. The leading edge 126 on the hook 124 is angled away from the outlet during insertion.

Thus, the leading edge 126 is positioned and angled to bear against a surface 134 in the receptacle 132 during insertion and yet to not catch on the surface. Instead, the catch leg 108 will be pushed down against the spring bias upon contact of the hook 124 with the outlet surface 134. This will automatically move the male catch lever 100 from the catch position toward the release position of FIG. 8, which clears the hook 124 past the surface 134 of the receptacle 132. The male prongs 46, 48 can then be fully inserted into the corresponding receptacles without depressing the actuator 62. As soon as the male prongs 46, 48 are fully inserted, the spring 102 will fire male catch lever 100 back to the catch position. The catch edge 128 can then seat against and catch on a vertical surface 136 within the receptacle 132 of the outlet 130 as in FIG. 9. The catch edge 128 prevents the male prong 46 and thus both prongs 46, 48 from being removed or withdrawn from the corresponding female receptacles 132 of the standard wall outlet 130. The plug adapter 30 thus can be inserted without actuating the button 64 and remains connected to the outlet until the catch mechanism is released.

The adapter can be released by pushing the button 64 on the actuator 62 into the side 38 of the body. This moves the catch lever 100 down into the notch 120, as described above, into the release position. This moves the hook out of the way, clears the catch edge 128 from the surface or obstruction 136 in the outlet, and allows the user to withdraw the male prong 46, and thus both prongs 46, 48, from the corresponding female receptacles 132 to remove the adapter.

In one example, the female end 36 of the plug adapter 30 can employ a one-way retention mechanism in one, two, or all three of the female receptacles 70, 72, or 74. In this example, the one-way retention mechanism is provided on the back ends 84 and 86 of the male prongs 46 and 48. The retention mechanism in this example is a curved or bent metal tang 140 that projects laterally out of plane at an angle from a plane of one of the contacts or contact surfaces 88 on the back ends 84 and 86. With reference to the prong 46, the tang 140 projects inward into the gap between the contacts 88 and 90 and forward within the female receptacle 70.

Figure 10:
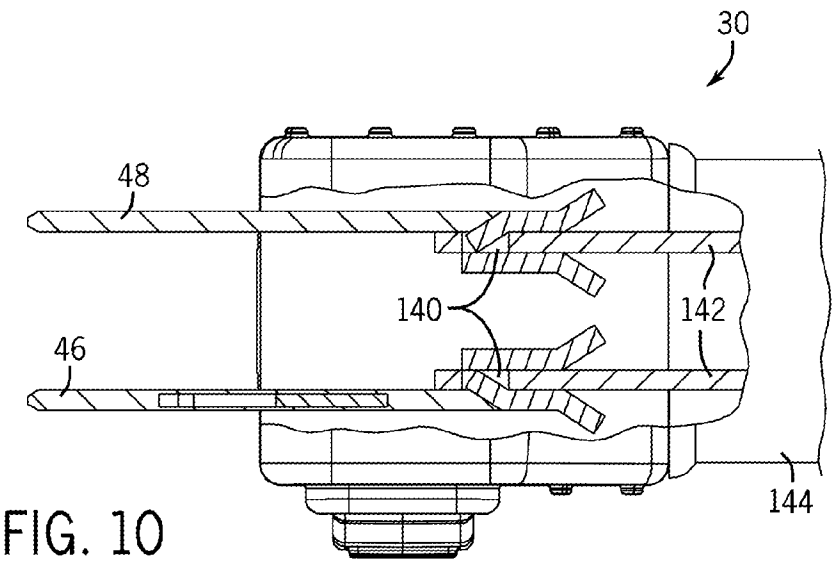
FIG. 10 shows a cross-section along line X-X of the plug adapter in FIG. 1 and with a male electrical connector inserted into the female end of the plug adapter.

As shown in FIG. 10, when a male connector prong 142 from a standard electrical connector 144 is inserted into the female receptacle 70, the tang 140 can spring or pop into an opening 146 (see the opening in FIG. 1 through the prong 46 for a similar opening) in the end of the prong 142. Alternatively, the tang 140 can have a sharp tip that digs into the surface of the prong. In either case, the tang 140 prevents pulling the prong 142 out of the receptacle 70 in the reverse direction. The tang 140 can securely retain the male connector prong 142 within the female receptacle 70. Thus, the tang 140 can serve to prevent the male connector 144 from being removed from the plug adapter 30. In this manner, use of a one-way retention mechanism, such as the tang 140, can permanently retain the plug adapter 30 connected to the cord of an appliance, tool, or the like, when inserted into the adapter. When the adapter 30 is attached to the plug or connector 142 of an appliance, it is intended to stay attached in this example.

As noted above, the one-way female retention mechanism can also be employed within the female receptacle 72 and/or the receptacle 74. As show in FIG. 5, the back end 86 of the male prong 48 employs the same retention component, such as the tang 140. The tang 140 on the back end 86 functions the same as the tang 140 on the back end 84 as described above. The multiple tangs 140 will render the connection between the plug adapter 30 and a male tool or appliance connector 144 more robust. In another example, the one-way retention mechanisms need not be formed on the back of the male prongs 46, 48 respectively, but instead can be coupled to or formed as a part of another component of the plug adapter 30. In yet another example, a tang 140 or other such female retention mechanism can be provided within the coupler 50 that defines the female receptacle 74, if desired. In addition, the one-way retention mechanism need not include the one or more bent metal tangs 140, but instead can be configured to retain the male connector prong in a different manner and yet fall within the teachings of the present invention.

Figure 11:
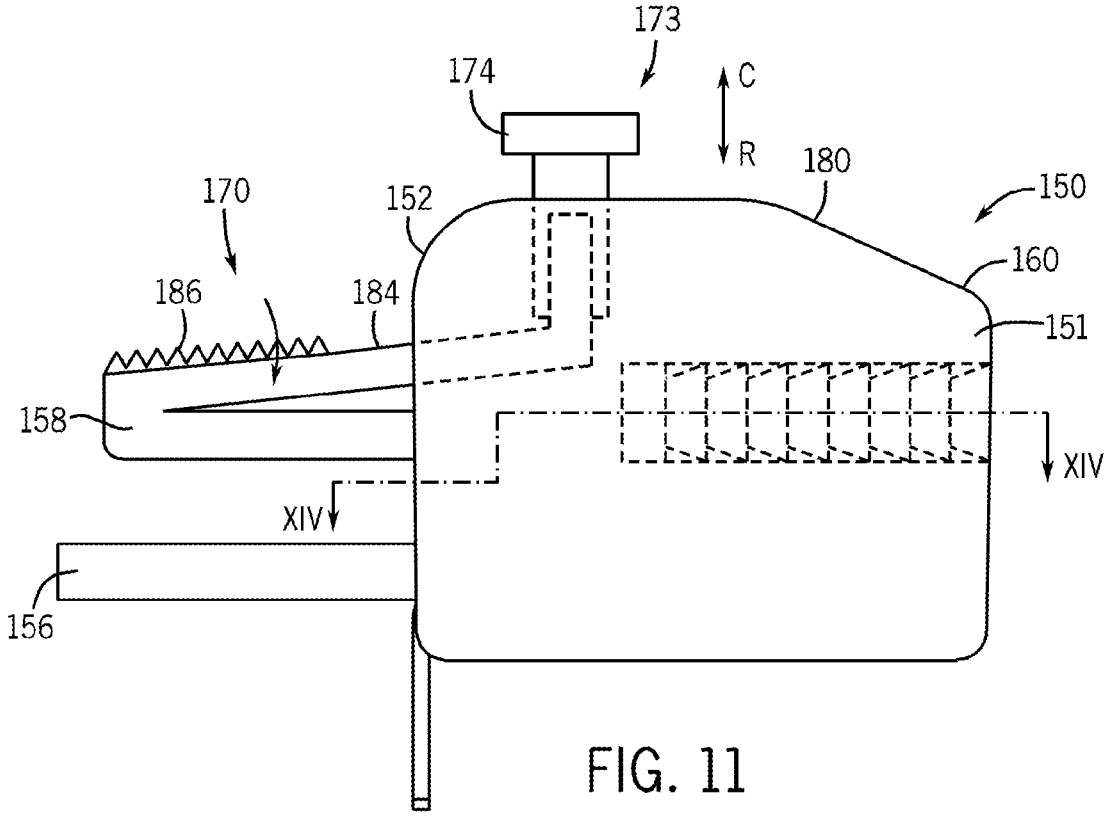
FIG. 11 shows a side view of an alternate example of a plug adapter constructed in accordance with the teachings of the present invention.

Turning now to the drawings, FIG. 11 shows a schematic or cut away side view of another example of a plug adapter 150 constructed in accordance with the teachings of the present invention. In this example shown in FIG. 12, the plug adapter 150 has a plug body 151 with three male prongs extending from a surface M on a male end 152 of the body. The three male prongs in this example include a positive male prong 154, a ground male prong 156, and a neutral male prong 158. The plug body 151 also has a surface F on a female end 160 as shown in FIG. 13 with three female receptacles into the surface F. The three receptacles in this example include a positive receptacle 162 for receiving a positive male prong, a ground receptacle 164 for receiving a ground male prong, and a neutral receptacle 166 for receiving a neutral male prong of an electrical plug (not shown) from a tool, appliance, or the like.

As noted above, and as will be evident to those having ordinary skill in the art upon reading this disclosure, the number, size, orientation, and arrangement of the prongs and receptacles can vary from that shown. Additionally, the size and configuration of the plug body and the material from which it is made can also vary. Further, the material and construction of the receptacles and prongs can also vary within the spirit and scope of the invention.

In this example, one of the male prongs of the adapter 150, the neutral prong 158 for example, can be configured as the male latching prong. Here, the neutral or latching prong 158 has a male catch or plug retention mechanism 170. The male catch mechanism 170 can be selectively moved from a lock or catch position to a release position as shown in FIG. 11 via the arrows C (catch direction) and R (release direction). Also in this example, one of the female receptacles, receptacle 164 for example as in FIGS. 11 and 14, can have a "permanent," one-way, or non-releasable female catch or prong retention mechanism 172 for coupling with a male prong on a plug of a tool, appliance, or the like. In this example, the plug adapter 150 is thus also configured for particular use on a device or appliance where there is no intention of removing the plug adapter from the appliance cord once attached.

In one example, the male catch mechanism 170 on the single male prong 158 is actuated or moved via an actuator 173 on the plug body. In one example, the actuator 173 can include a push button 174 coupled to a stalk 176 that projects from a surface of the plug body 151. In this example, the push button 174 projects from the top surface 180 of the plug body 151. The push button 174, and in this case the stalk 176, can be coupled to a resiliently movable portion 182 of the male prong 158. In the disclosed example, the movable portion 182 of the prong 158 includes one edge 184 with a plurality of teeth 186 that form a serrated or saw-toothed configuration.

The prong 158 in this example can be formed at least partly of a resilient material such as spring steel so that the teeth 186 are biased upward, away from the prong 158, to the locked or catch position. Thus, the portion 182 can be integrally formed as a part of the prong 158, if desired. In another example, the movable portion can be a separate component that is pivotally, laterally, translationally, and/or slidably joined to the prong 158. Thus, the portion 182 need not be formed of the same material as the prong 158, i.e., metal. Instead, the portion 182 can be formed of a plastic material or other suitable material, if desired. A biasing element, such as a spring, can also be employed, if desired, to bias the portion 182 away from the prong 158 to the catch position.

Depressing the button 174 of the actuator 173 into the plug body 151 in this example will drop or move the serrated edge 186 toward the prong 158. This will create clearance between the teeth 186 and an exposed surface, edge, or object inside a conventional socket receptacle or outlet (not shown). The clearance will permit the male prongs 154, 156, and 158 to be inserted into or removed from a conventional female receptacle or outlet. Releasing the button 174 allows the resilient nature of the portion 158 to raise or move the serrated edge 184 away from the prong 158, creating interference contact between one of the teeth 186 on the serrated edge and a shoulder, surface, edge, or object (such as the surface 136 noted above) within a conventional female wall outlet receptacle. The male catch prong 158 can be provided on any one of the prongs including the "hot" or positive prong, the "ground" prong, or the "neutral" prong (as shown) or on more than one of the prongs.

Figure 14:
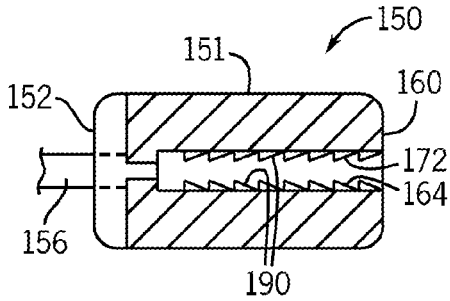
FIG. 14 shows a longitudinal cross-section along line XIV-XIV of the plug adapter in FIG. 11.

In one example, the permanent or one-way female catch mechanism 172 in the single female receptacle 164 can be provided in multiple ones of the female receptacles, or in only one of the receptacles, as desired. The female catch mechanism 172 in FIGS. 11 and 14 can be provided in the form of a plurality of one-way metal projections or tangs 190 extending laterally from the side surfaces 192 in the receptacle space 164. The projections 190 can be shaped and oriented in a direction to permit insertion of a male prong into the female receptacle. The projections 160 can have sharp barbs or ends angled away from the insertion direction, as shown in FIG. 14, that dig into the material of a male prong upon insertion into the female receptacle 164. The angle and construction of the sharp tangs or ends 190 can thus prevent or significantly inhibit the male prong from being withdrawn from the receptacle 164 once inserted.

As will be evident to those having ordinary skill in the art, the configuration and construction of the female catch mechanism of the disclosed adapters can vary and yet fall within the spirit and scope of the present invention. The intention is that once the disclosed adapters are attached to the cord plug of an appliance, tool, or the like, it is difficult to remove. The configuration and construction of the male, releasable, catch mechanism can also vary from the examples shown. The male catch mechanism is a releasable device that allows the plug adapter to be inserted into, positively retained in, and selectively released from a standard wall outlet or electrical socket. Thus, the disclosed adapters 30 and 150, if the female catch mechanisms 140 or 172 are utilized, are quite suitable for use on devices and in situations and circumstances where installation of the plug adapters 30 or 150 on an appliance cord is intended to be permanent and where installation into a standard outlet or socket is intended to be retained until one desires to unplug the appliance from the outlet.

As a result, the disclosed adapters can be particularly useful for construction tools and in construction sites. A typical worker will not need to remove the adapter plug from the tool or device once installed, but will want the adapter plug to be removable from the electrical outlet, but only when desired. A separate adapter can be applied to each of the tools or devices in the field, if desired. During use, the disclosed adapters 30 or 150 are intended to stay plugged in if knocked, tugged, or bumped inadvertently. The male catch mechanisms can be configured to employ a break-away aspect where, if bumped, knocked, or tugged too hard, the catch mechanism will release or break without harming the outlet or the appliance cord. Once broken away, the plug adapter could be used without the releasable catch feature or the entire adapter and plug end on the appliance cord could be replaced.

Figure 12:
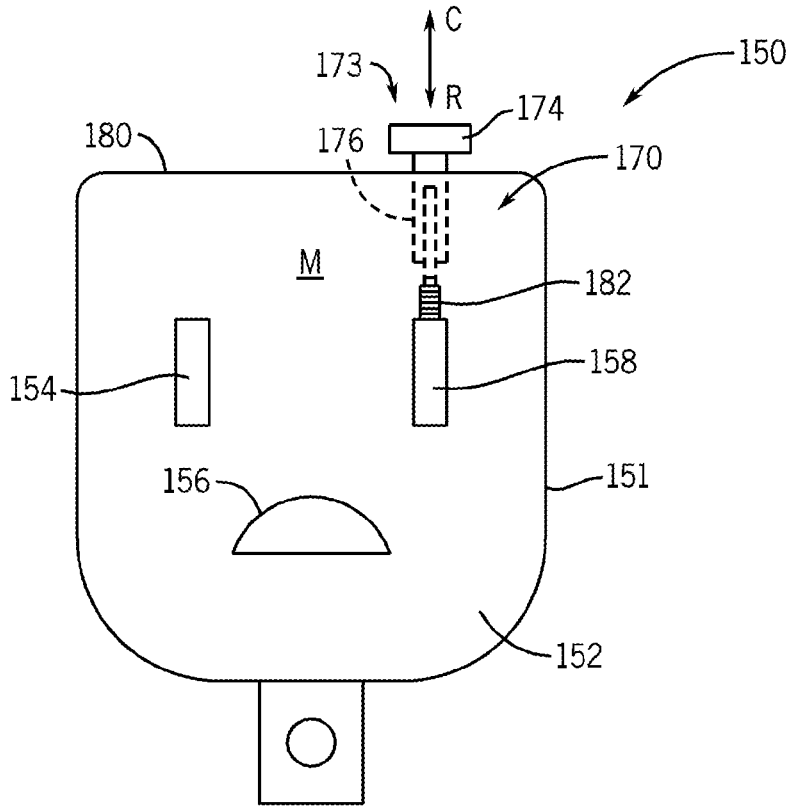
FIG. 12 shows an end view of the male end of the plug adapter in FIG. 11.
Figure 13:
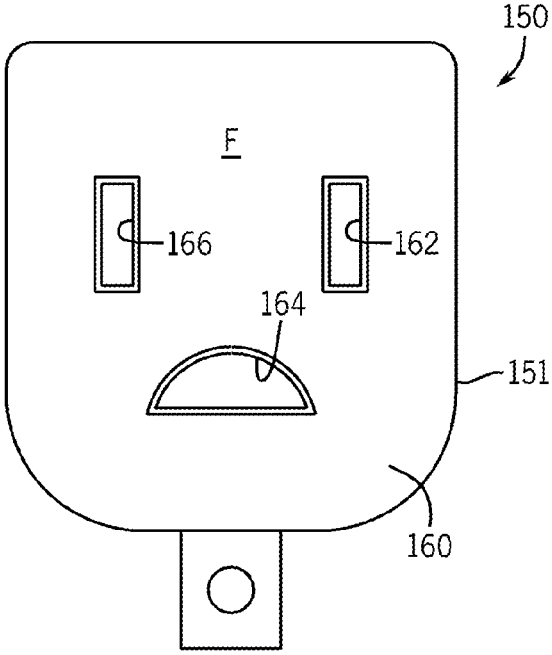
FIG. 13 shows an end view of the female end of the plug adapter in FIG. 11.
Figure 15:
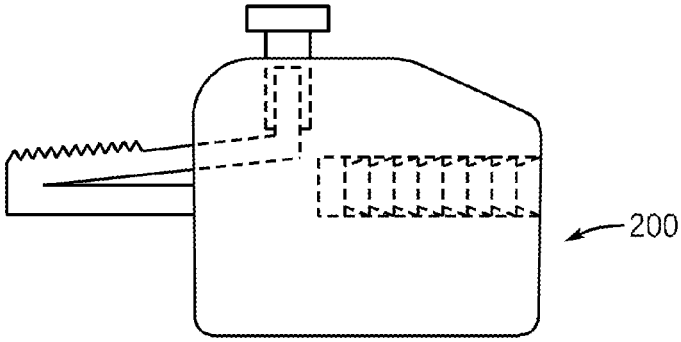
FIG. 15 shows a side view of another alternate example of a plug adapter constructed in accordance with the teachings of the present invention.

As shown in FIGS. 11-13, the disclosed adapters can be configured to have three female receptacles on the female end and three male prongs on the male end for a conventional U.S. grounded connection. Clearly, other plug receptacle and prong arrangements, such as old technology and non-U.S. technology configurations or high amp configurations, can fall within the spirit and scope of the present invention, as noted above. For example, a typical two prong and two receptacle plug arrangement with a male catch mechanism as disclosed herein can fall within the spirit and scope of the present invention. FIG. 15 shows an alternative plug adapter 200 with such an arrangement, i.e., with no male ground prong and no female ground receptacle.

Figure 16:
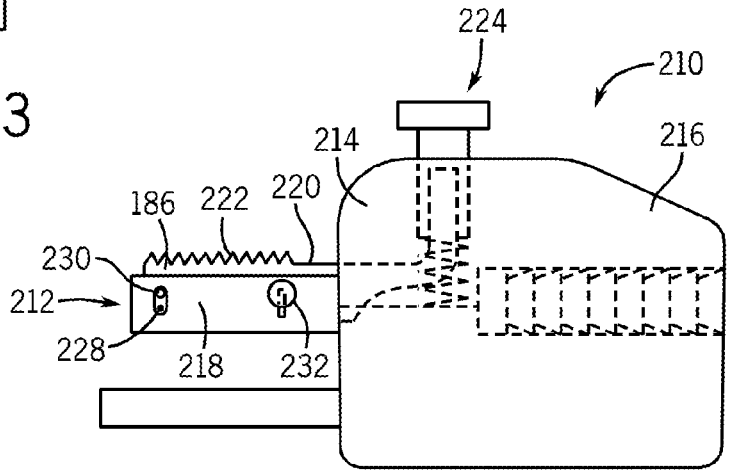
FIG. 16 shows a side view of another alternate example of a plug adapter constructed in accordance with the teachings of the present invention.

FIG. 16 illustrates another example of a plug adapter 210 constructed in accordance with the teachings of the present invention. This example illustrates a modified male latching prong 212 with a male catch mechanism 214. The male latching prong 212 in this example includes a dual blade construction that has two blade portions 216 and 218 that are positioned side-by-side adjacent one another. One of the blade portions 216 can move up and down relative to the other fixed blade portion 218. In this example, the movable blade portion 216 has a top edge 220 with serrations or teeth 222 similar to the prior example. A button or other actuator 224 can be provided on the plug body 226 and be manipulated to move the serrated blade portion 216 toward or in line with the fixed portion 218 in a release position. In the release position, the prong portion 216 will permit the prong 212 to be inserted into and removed from a female receptacle. The button or actuator 224 can be released to cause the serrated movable prong portion 216 to move away from or out of alignment with the fixed portion 218 to a catch position. In the catch position, the teeth are positioned to catch on a surface, object, edge, or shoulder within the standard outlet female receptacle to retain the plug adapter in the installed condition. In one example, slots 228 and pins 230 with torsion springs 232 can be provided connecting the two blade portions 216, 218 together and biasing the movable blade portion upward as shown. The button or actuator 224 can be configured to overcome the biasing force of the springs 232 to lower the movable blade portion 216.

Other biasing arrangements, catch or locking mechanisms, and prong or blade configurations can also be designed and yet perform the intended functions. In the examples of FIGS. 15 and 16, the biased movement of the male prong with the serrated top edge can also be employed in a variety of ways and yet fall within the spirit and scope of the present invention. In the examples shown, the male prong can be configured as a unitary spring-steel or other resilient material prong with one part resiliently movable relative to the other part. In another example, one of the two parts can be pivotally or movably connected and spring biased upward relative to the other part. In a further example, an entire male prong can be positioned and configured on the plug so that the entire prong can move upward or downward relative to the plug adapter body or housing.

Figure 17:
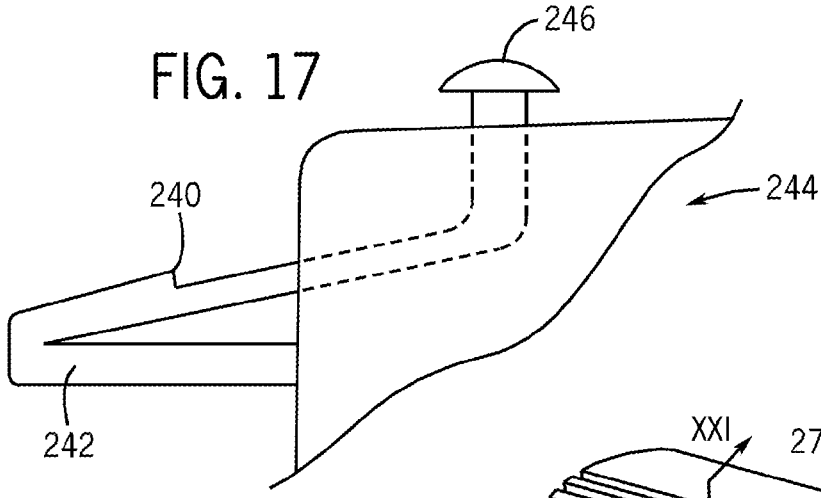
FIG. 17 shows a side view of another alternate example of a plug adapter constructed in accordance with the teachings of the present invention.

Some of the male catch mechanisms in the disclosed examples include a serrated edge with multiple serrations. The serrations can be formed so that the male end can be readily and easily inserted into a conventional female socket receptacle and yet prevent withdrawal unless the button or actuator is depressed. If desired, the serrations can be formed to permit insertion of the male prong without having to depress the actuator or button. As shown in FIG. 17, the multiple serrations on one of the prongs can be replaced by a single serration 240, hook, tooth, or the like. In this example, a single tooth 240 can be positioned along the latching prong 242 so as to cooperate with a shoulder, lip, protrusion, surface, object, or edge in a conventional receptacle or socket structure to retain the adapter 244 within the female socket until the actuator or release button 246 is used to release the adapter. This example has similarities in common with the first adapter 30 described herein.

Figure 18:
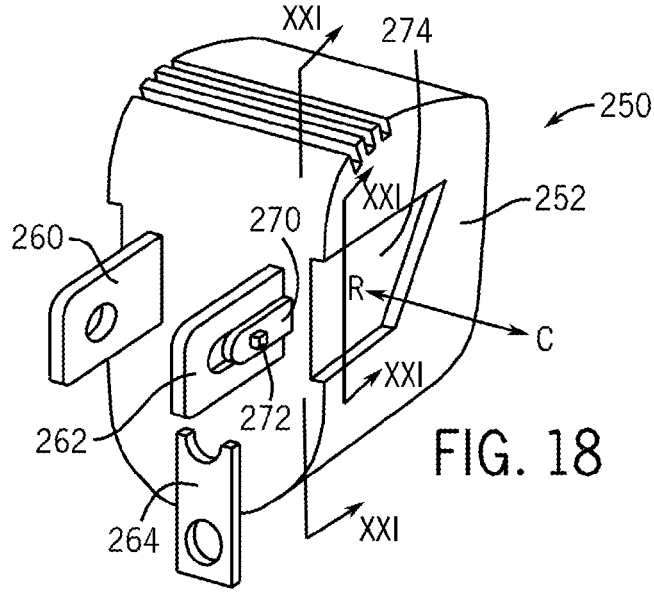
FIG. 18 shows a perspective view of another alternate example of a plug adapter constructed in accordance with the teachings of the present invention.
Figure 19:
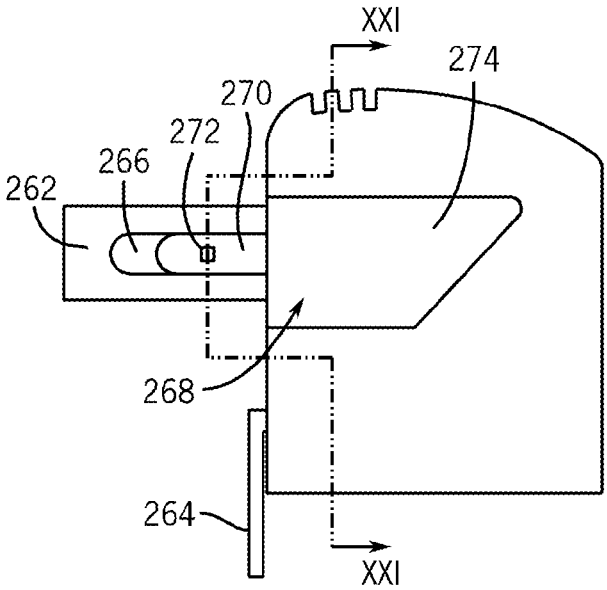
FIG. 19 shows a side view of the plug adapter in FIG. 18.
Figure 20:
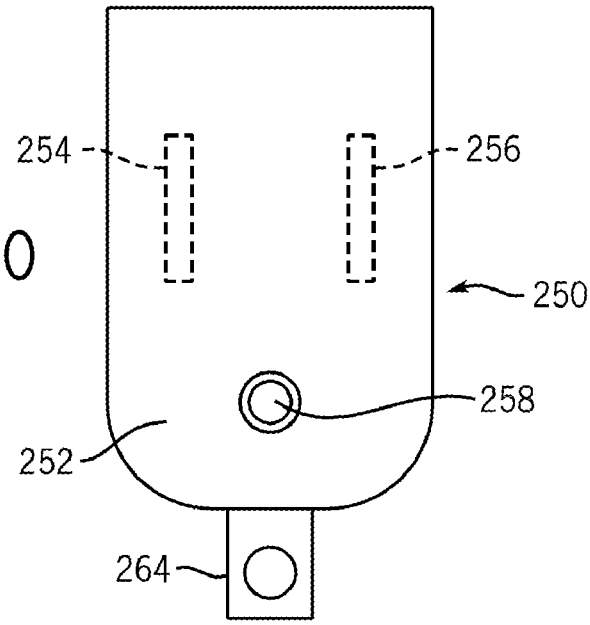
FIG. 20 shows an end view of the female end of the plug adapter in FIG. 18.

FIGS. 18-20 show yet another example of a plug adapter 250 constructed in accordance with the teachings of the present invention. In this example, the adapter 250 has a plug body 252 with three female receptacles 254, 256, and 258 as depicted in FIG. 19. As with the first example discussed above, one of these receptacles can be provided with a one-way female catch mechanism if desired. The adapter 250 also has three male prongs 260, 262, and 264 depicted in FIG. 18. The latching prong 262 in this example is a flat blade with a central opening 266 in the blade and has a releasable male catch mechanism 268 associated with the prong. The mechanism 268 has a catch blade 270 seated in the central opening. The catch blade 270 is biased to a plane that is offset relative to a plane of the latching prong blade as shown in FIG. 8.

Figure 21:
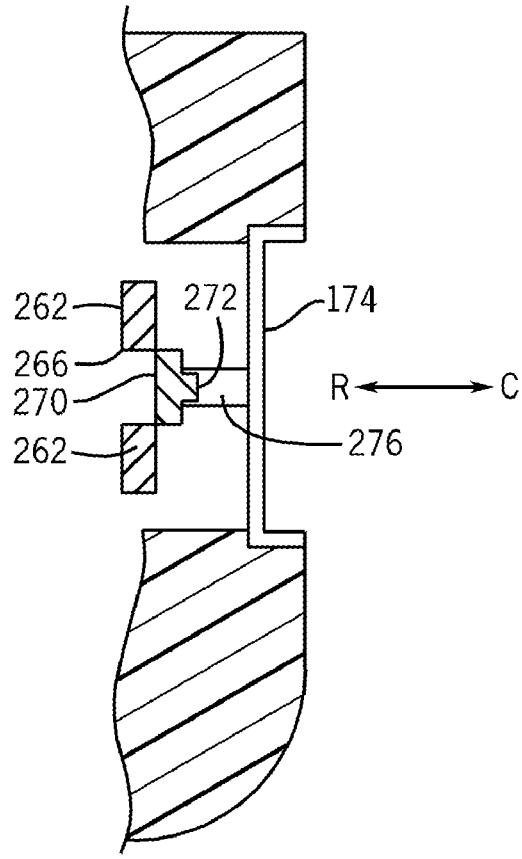
FIG. 21 shows a cross section along line XXI-XXI through the plug adapter in FIG. 18.

In this example, the catch prong 270 can be formed of a material that is different from the latching prong 262, such as plastic. The catch prong can have a tooth 272, projection, hook, catch, or the like that projects outward from a side of the prong, in this instance outward in a direction away from the prong 260. The plastic can be formed as a resilient finger or blade 270 or can be resiliently biased by a spring or other biasing device outward to the offset catch position in the direction of the arrow C. As shown in FIGS. 18, 20, and 21, an actuator surface 274 on a side of the plug body can be squeezable inward, or both sides of the body can be squeezed inward into the body. Movement in this release direction R can cause the catch prong to move into co-planar alignment with the latching prong 262, or further into the opening 266, so that the tooth or projection 272 lies flush or nearly flush with the prong 262. In this position, the catch prong will permit the prong 262 to be inserted into or released from an outlet receptacle.

In one example, the actuator surface can be positioned over a pocket 276 in the plug body 252 as in FIG. 21. The actuator surface 274 can be a thinner wall thickness or membrane that is squeezable or movable relative to the surrounding body. A contact 278 can be provided on the catch prong 270 that is in contact with the actuator surface 274. When moved or squeezed inward, the surface 274 can push the contact inward, which in turn will push the catch prong to the release position in alignment with the latching prong 262.

By forming the catch prong from plastic, the shape and size of the projection 272 can be designed to retain the plug adapter 250 installed until a break away or removal threshold force is reached. Upon surpassing the threshold force, the catch prong and/or the tooth or projection 272 can be designed to release from the outlet socket or break.

In other embodiments, the buttons or actuators can be replaced with a sliding device, a twisting actuator, or other mechanism that can move the single male catch prong of the disclosed adapters. In addition, the buttons or other actuators can be placed anywhere on the plug body or housing within the spirit and scope of the invention. The buttons or actuators can be placed on a top or side of the adapter body as shown in the drawings herein. Alternatively, the buttons or actuators can be placed on either side or on the bottom of the adapter body and yet fall within the scope of the invention. In one example, two different adapters can be provided for use in a standard double receptacle wall outlet. One of the adapters can have an actuator that is accessible on a top of the body for use within an upper one of the female receptacles of the outlet or socket. Another of the adapters can have an actuator that is accessible on the bottom of the adapter body for use within a bottom one of the female receptacles of the outlet or socket. In a further example, both adapters can have an actuator on a side of the adapter body, thus rendering the actuator accessible regardless as to whether the adapter is inserted into an upper or lower one of the standard female receptacles of the double outlet or socket.

In another example, an extension cord can be provided that has a female connector end compatible with the disclosed adapters and that has a male lock/release connector end at the other end of the cord. The male end of the cord can include two or more male prongs and incorporate the catch or lock mechanism as described above. The female end of the cord can include a female receptacle configured with a shoulder, lip, or catch surface identical or similar to that of a standard socket receptacle. Thus, the extension cord can be used in conjunction with one of the adapters described above wherein the male end of the extension cord is releasably inserted into a standard socket outlet and the female end receives the releasable male prongs of a previously described adapter, which has been connected to a power cord of an electronic device.

Figure 22:
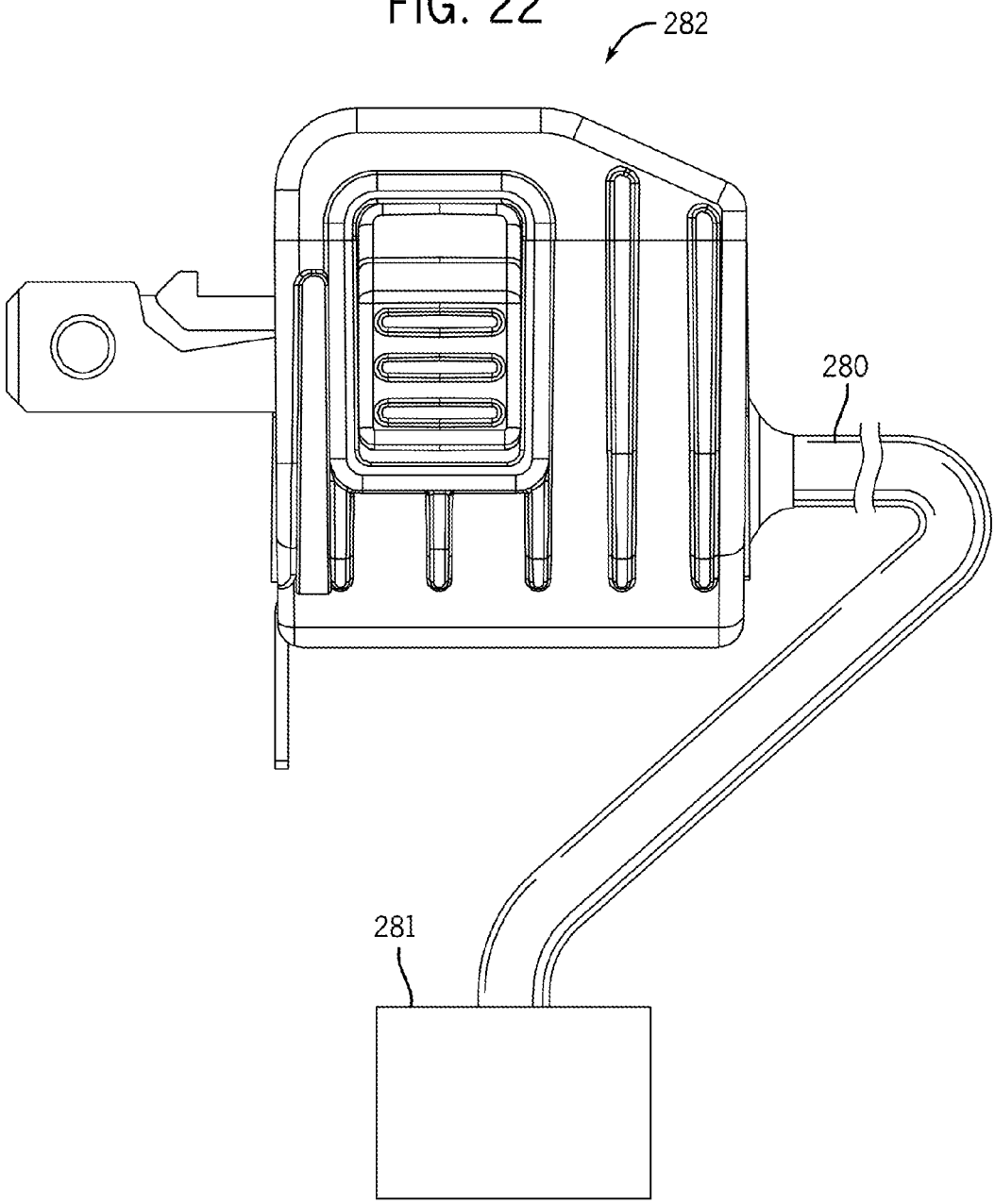
FIG. 22 shows a side view of a male plug connector or adapter on an appliance cord and constructed in accordance with the teachings of the present invention.

In yet another example shown in FIG. 22, an appliance cord 280 can have one end attached to and extending from a tool, appliance, or the like 281. The other end of the cord can include a male plug connector 282 connected to the cord 280. The cord end replaces the prior described female receptacle ends of the adapters. The male plug connector 282 can be provided having a male catch mechanism as described herein. The appliance cord can thus be releasably secured in an outlet and removed only when the mechanism is released.

Although certain plug adapters have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. An electrical plug adapter comprising:

a plug body;

female receptacles in one surface of the plug body;

male prongs extending from another surface of the plug body;

a male catch mechanism associated with one of the male prongs and resiliently biased to a catch position relative to the one male prong, the male catch mechanism configured to catch on an object in a standard electrical outlet when the male prongs are inserted into corresponding receptacles of the standard electrical outlet;

an actuator on the plug body configured, when actuated, to selectively move the male catch mechanism to a release position relative to the one male prong and allow the male prongs to be removed from the corresponding receptacles;

a spring coupled between the male catch mechanism and the actuator, wherein the spring is configured to bias the male catch mechanism to the catch position; and a one-way retention mechanism associated with one of the female receptacles and configured to permanently retain a male connector prong from a standard electrical connector plug when inserted into the female receptacles.

2. The electrical plug adapter of claim 1, wherein the male prongs can be inserted into the corresponding receptacles when the male catch mechanism is in the catch position without actuating the actuator.

3. The electrical plug adapter of claim 1, wherein the male catch mechanism comprises:

a catch lever with a catch leg adjacent to a profile edge of the one male prong and an actuation leg located in the plug body, the catch lever being pivotably coupled to the plug body;

a hook positioned at a tip of the catch lever; and a spring coupled to the actuation leg.

4. The electrical plug adapter of claim 1, wherein the retention mechanism is a metal tang projecting inward from a surface of the one female receptacle and configured to engage a portion of the male connector prong when inserted therein and prevent removal therefrom.

5. The electrical plug adapter of claim 1, further comprising a gripping surface on the plug body, the gripping surface formed from a material different than a material used to construct the plug body.

6. The electrical plug adapter of claim 1, wherein the male catch mechanism includes a hook positioned at an end of part of the male catch mechanism.

7. The electrical plug adapter of claim 6, wherein the hook projects beyond a profile edge of the one male prong when the male catch mechanism is in the catch position, and wherein the hook lies within the profile edge of the one male prong when the male catch mechanism is in the release position.

8. The electrical plug adapter of claim 6, wherein the hook catches on an edge of an opening in the standard electrical outlet when the male catch mechanism is in the catch position and the male prongs are inserted into the corresponding receptacles.

9. An electrical plug adapter comprising:

a plug body;

female receptacles in one surface of the plug body;

male prongs extending from another surface of the plug body;

a male catch mechanism adjacent to one of the male prongs and resiliently biased to a catch position relative to the one male prong, the male catch mechanism being a pivotable lever with one end aligned with the one male prong and having a hook at one end with an angled or tapered leading end and configured to catch on an object in a standard electrical outlet when the male prongs are inserted into corresponding receptacles in the standard electrical outlet; and an actuator on the plug body configured, when actuated, to selectively move the male catch mechanism to a release position relative to the one male prong and allow the male prongs to be removed from the corresponding receptacles, wherein the male prongs can be inserted into the corresponding receptacles when the male catch mechanism is in the catch position without actuating the actuator.

10. The electrical plug adapter of claim 9, further comprising a one-way retention mechanism associated with one of the female receptacles and configured to permanently retain a male connector prong from a standard electrical connector plug when inserted into the female receptacles.

11. The electrical plug adapter of claim 9, wherein the hook projects beyond a profile edge of the one male prong when the male catch mechanism is in the catch position, and wherein the hook lies within the profile edge of the one male prong when the male catch mechanism is in the release position.

12. The electrical plug adapter of claim 9, wherein the leading end of the hook is shaped to cause the catch mechanism to move from the catch position to the release position when the male prongs are initially inserted into the corresponding receptacles and wherein the catch mechanism returns to the catch position after the male prongs are inserted into the corresponding receptacles and the hook has passed beyond the object therein.

13. An electrical connector plug comprising:

a plug body;

male prongs extending from a surface of the plug body;

an electrical cord extending from another surface of the plug body, the electrical cord coupled to an electric appliance;

a male catch mechanism adjacent one of the male prongs and resiliently biased to a catch position relative to the one male prong, the male catch mechanism configured to catch on an object in a standard electrical outlet when the male prongs are inserted into corresponding receptacles of the standard electrical outlet; and an actuator on the plug body configured, when actuated, to selectively move the male catch mechanism to a release position relative to the one male prong and allow the male prongs to be removed from the corresponding receptacles, wherein the male prongs can be inserted into the corresponding receptacles when the male catch mechanism is in the catch position without actuating the actuator, and wherein the male catch mechanism includes a catch blade configured to pivot in a perpendicular direction relative to the one male prong between the catch position and the release position.

14. An electrical connector plug comprising:

a plug body;

male prongs extending from a surface of the plug body;

an electrical cord extending from another surface of the plug body, the electrical cord coupled to an electric appliance;

a male catch mechanism adjacent one of the male prongs and resiliently biased to a catch position relative to the one male prong, the male catch mechanism configured to catch on an object in a standard electrical outlet when the male prongs are inserted into corresponding receptacles of the standard electrical outlet; and an actuator on the plug body configured, when actuated, to selectively move the male catch mechanism to a release position relative to the one male prong and allow the male prongs to be removed from the corresponding receptacles, wherein the male prongs can be inserted into the corresponding receptacles when the male catch mechanism is in the catch position without actuating the actuator, and wherein the male catch mechanism includes a catch blade with a serrated edge, the catch blade being moveable such that the serrated edge moves toward the one male prong to the release position when the actuator is actuated and away from the one male prong when returning to the catch position.

15. The electrical connector plug of claim 14, wherein the catch blade is positioned side-by-side adjacent and parallel to the one male prong.

16. The electrical connector plug of claim 15, wherein the serrated edge is parallel to but spaced from an edge of the one male prong in the catch position and is parallel and side-by-side adjacent to the edge of the one male prong in the release position.

17. An electrical connector plug comprising:

a plug body;

male prongs extending from a surface of the plug body;

an electrical cord extending from another surface of the plug body, the electrical cord coupled to an electric appliance;

a male catch mechanism adjacent one of the male prongs and resiliently biased to a catch position relative to the one male prong, the male catch mechanism configured to catch on an object in a standard electrical outlet when the male prongs are inserted into corresponding receptacles of the standard electrical outlet; and an actuator on the plug body configured, when actuated, to selectively move the male catch mechanism to a release position relative to the one male prong and allow the male prongs to be removed from the corresponding receptacles, wherein the male prongs can be inserted into the corresponding receptacles when the male catch mechanism is in the catch position without actuating the actuator, and wherein the male catch mechanism further comprises a catch lever having a catch leg adjacent to a profile edge of the one male prong and an actuation leg located in the plug body, the catch lever being pivotably coupled to the plug body, a hook positioned at a tip of the catch leg, and a spring coupled to the actuation leg and biasing the catch lever to the catch position.

18. An electrical extension cord comprising:

a male connector plug body;

male prongs extending from a surface of the male plug body;

an electrical cord with one end coupled to and extending from another surface of the male plug body;

a female connector plug coupled to an opposite end of the electrical cord;

a male catch mechanism adjacent one of the male prongs and resiliently biased to a catch position relative to the one male prong, the male catch mechanism having a catch blade configured to pivot in a perpendicular direction relative to the one male prong between the catch position and the release position and configured to catch on an object in a standard electrical outlet when the male prongs are inserted into corresponding receptacles of the standard electrical outlet; and an actuator on the plug body configured, when actuated, to selectively move the male catch mechanism to a release position relative to the one male prong and allow the male prongs to be removed from the corresponding receptacles, wherein the male prongs can be inserted into the corresponding receptacles when the male catch mechanism is in the catch position without actuating the actuator.

19. The electrical extension cord of claim 18, wherein the female connector plug includes a female receptacle having another catch surface therein that is compatible to engage with the male catch mechanism.

20. the electrical extension cord of claim 18, wherein the female connector plug has a female receptacle with a one-way retention mechanism associated therewith and configured to permanently retain a male connector prong from a standard electrical connector plug when inserted into the female receptacle.

* * * * *